United States Patent [19]

White

[11] 4,208,220

[45] Jun. 17, 1980

[54] METHOD AND APPARATUS FOR CLEANING HEAT EXCHANGER TUBES MOUNTED TRANSVERSELY TO VERTICAL FLOW OF SEAWATER

[75] Inventor: Henry J. White, Hawaii Kai, Hi.

[73] Assignee: The Research Corporation of the University of Hawaii, Honolulu, Hi.

[21] Appl. No.: 905,925

[22] Filed: May 15, 1978

[51] Int. Cl.[2] ..... B08B 1/00; B08B 9/06

[52] U.S. Cl. ..... 134/7; 134/10; 15/104.04; 165/95; 165/DIG. 13

[58] Field of Search ..... 165/1, 95, 84, 94, 180, 165/DIG. 13; 15/104.04, 104.06 R, 3.5, 3.51; 134/7, 8, 10, 22 R, 22 C; 51/290

[56] References Cited

U.S. PATENT DOCUMENTS

| | | | |
|---|---|---|---|
| 2,801,824 | 8/1957 | Taprogge | 165/95 |
| 3,090,166 | 5/1963 | Straub | 134/7 UX |
| 3,130,778 | 4/1964 | McColl | 165/94 X |
| 3,291,197 | 12/1966 | Kollerup | 165/1 |
| 3,369,598 | 2/1968 | List | 165/94 X |
| 3,543,324 | 12/1970 | Knapp et al. | 15/104.06 R |
| 3,573,985 | 4/1971 | Schultz | 15/104.06 X |
| 3,841,397 | 10/1974 | Eimer | 165/95 |
| 3,919,732 | 11/1975 | Honma et al. | 165/95 X |
| 3,978,917 | 9/1976 | Honma et al. | 165/95 |
| 4,079,782 | 3/1978 | Soderberg | 165/95 |

FOREIGN PATENT DOCUMENTS 525076 12/1953 Belgium .

*Primary Examiner*—Richard V. Fisher
*Attorney, Agent, or Firm*—James C. Wray

[57] ABSTRACT

The invention is an apparatus and method for cleaning outsides of heat exchange tubes mounted transversely to the vertical flow of seawater in Ocean Thermal Energy Conversion plants. The invention comprises a number of small floating objects circulating in the seawater flow which randomly clean outside surfaces of heat exchange tubes. The floating objects are made of buoyant plastic foam encased in polyethylene or other material selected to maximize cleaning but minimize wear on the outside surfaces of the tubes. The preferred shape of the floating objects is generally fusiform, altered to have erratic motion in seawater flow. Appendages may trail from the floating objects to increase the randomness of the cleaning action.

The flow of seawater is arranged to provide a constantly circulating path for the floating objects to rise through slow downward flow and to fall with greater downward flow velocity. Screens located above and below the heat exchanger prevent the floating objects from escaping. The screens have holes large enough to permit easy removal of worn floaters. The avoidance of symmetry in the orientation of the heat exchange tubes aids flow rate variation and consequently the random deflections of the floating objects.

30 Claims, 8 Drawing Figures

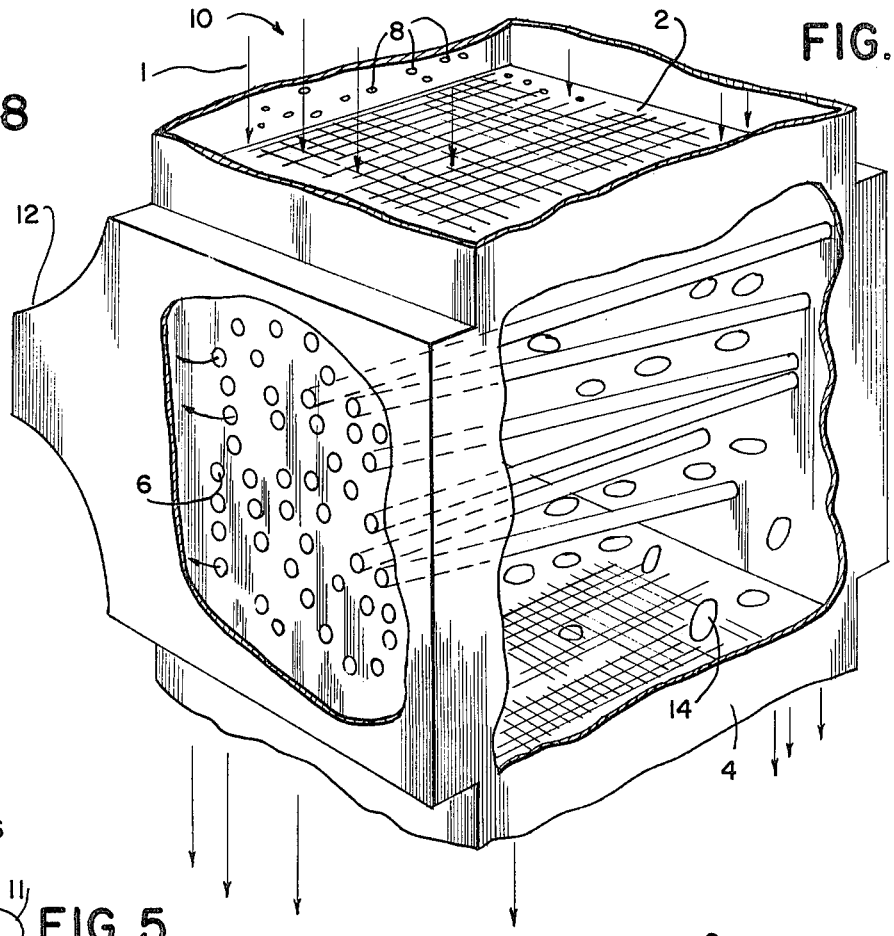
FIG. 1
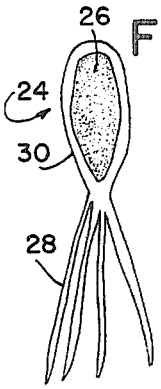
FIG. 8
FIG. 4
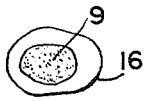
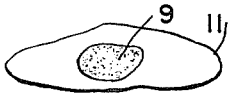
FIG. 5
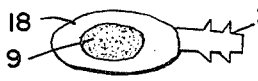
FIG. 6
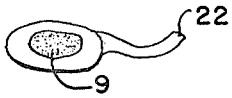
FIG. 7
FIG. 3
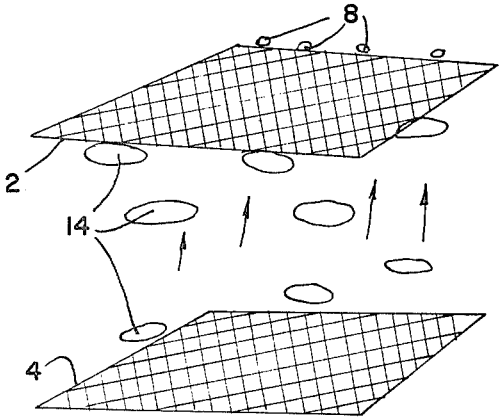
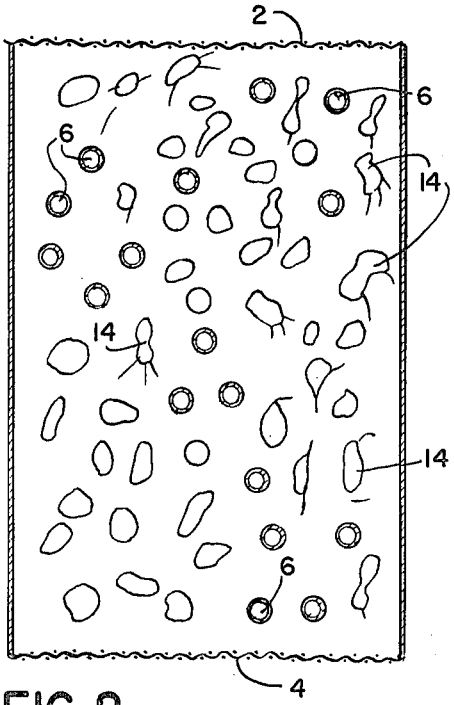
FIG. 2

METHOD AND APPARATUS FOR CLEANING HEAT EXCHANGER TUBES MOUNTED TRANSVERSELY TO VERTICAL FLOW OF SEAWATER

BACKGROUND OF THE INVENTION

1. Field of the Invention

The present invention relates generally to the field of heat exchange apparatus and more specifically to methods and apparatuses of cleaning these heat exchange devices.

2. Description of the Prior Art

Examples of pertinent patents are U.S. Pat. Nos. 3,130,778; 3,291,197; 3,369,598; 3,919,732 and Belgian Pat. No. 525,076.

Belgian Pat. No. 525,076 shows horizontally mounted heat exchange tubes. Elastic floating balls having a diameter equal to the interior diameter of the heat exchange tubes, abrade the interior walls of the tubes. The balls circulate by means of a pump which continually pushes balls through the holes of the tubes. A large pipe traps the floating balls and returns them to the pump for continuous cleaning of the tubes.

U.S. Pat. No. 3,919,732 shows a descaling system for condenser cooling tubes. Sponge balls are forced through cooling tubes by a three-switch valve capable of drawing out used descaling elements and introducing fresh descaling elements into the descaling line. A wire net disposed above the holder for the sponge balls prevents the balls from escaping from the holder.

U.S. Pat. No. 3,369,598 shows a heat exchanger having a filling of rolling bodies. A cylindrical housing is divided by plates into individual chambers and filled with rolling bodies. The rolling bodies are set into motion by rotation of the cylinder. The interior movement of the bodies against the cylinder cleans the surfaces of the cylinder. In addition the rolling bodies may be removed from the interior of the cylinder to effect movement outside the cylinder.

U.S. Pat. Nos. 3,130,778 and 3,291,197 show shot cleaning systems for heat exchangers. A recovery hopper means above the surfaces to be cleaned discharges steel shots onto the interior surfaces of the heat exchanger. After passing through the area to be cleaned the shots settle into a collection hopper. Pneumatic conveying means in U.S. Pat. No. 3,130,778 return the shots upward to the recovery hopper. Hydraulic pressure in U.S. Pat. No. 3,291,197 conveys shots upward to the recovery hopper means.

The present invention is a new and different apparatus and method for cleaning heat exchangers. Although some prior art, for example U.S. Pat. No. 3,919,732 and Belgian Pat. No. 525,076 show floating balls which abrade the surfaces of the heat exchange tubes, none has appendages trailing from them as does the present invention to increase the randomness of deflection of the balls against the tubes. As a result in prior art the floating bodies tend to clean in a more predictable pattern neglecting the cleaning of parts of the tube while over cleaning other parts. This increases the wear on parts of the tubes and allows sludge to build up on other parts of the tubes. Eventually uneven cleaning of the tubes contributes to an increasing lack of efficiency to exchange heat by the tubes. The fusiform shape of the floating bodies of the present invention further aids in making the movement of the floating bodies more erratic so that they will be more likely to clean all parts of the tubes.

The asymmetrical orientation of the tubes, mounted angularly to one another further increases the random movement of the floating bodies. This orientation causes the seawater flowing across the exterior of the tubes to vary in velocity due to different tube densities from area to area. The varying seawater flow allows the floating bodies to simultaneously rise and sink in the flow abrading both upper and lower surfaces of the heat exchange tubes.

None of the prior art shows tubes mounted asymmetrically, nor does any show varying seawater velocity flows.

The present invention may be adapted to clean a variety of heat exchange tubes depending upon the material from which the tubes were constructed. The floating objects of the present invention may be encased in whatever material which maximizes cleaning of marine fouling from the heat exchange tube but minimizes the wear on the material of the heat exchange tubes. None of the prior art demonstrates the flexibility of use of the present invention.

A significant new approach taken by the present invention is to clean the exterior surfaces of the heat exchange tubes. The prior art concentrates on cleaning the interior surfaces of the heat exchange tubes. The present invention directs its attention towards the exterior surfaces because poor thermal conductivity will result from fouled exterior surfaces as well as from fouled interior surfaces.

The present invention has protective screens which prevent the floating objects from escaping the area to be cleaned. The holes of the screen are large enough to permit worn floating bodies to pass through them so they can be easily removed. None of the prior art shows screens for keeping the floating bodies in the cleaning area. None of the prior art shows as simple a method of removing worn bodies as the present invention, as worn bodies are generally siphoned off by a valve means in prior art disclosures.

SUMMARY OF THE INVENTION

The present invention is a new method and apparatus for cleaning heat exchange tubes. Heat exchange tubes mounted transversely relative to the downward flow of seawater are abraded by floating plastic bodies which circulate against the exterior surfaces of the tubes.

The floating bodies are constructed from a buoyant plastic foam encased in polyethylene or other such material which will maximize cleaning but minimize the wear of the material on the surface of the tubes. The floating bodies are of a fusiform shape and may have appendages which trail from them. This makes the movement of the bodies in the seawater flow random and erratic so that all the surfaces of the tubes are cleaned.

The heat exchange tubes are mounted transversely to the downward vertical flow of the seawater and at angles relative to one another. The asymmetrical pattern of the tubes enables the seawater flow velocity to vary according to the tube density in different areas within the heat exchanger.

The floating bodies have a positive buoyancy such that they will rise or fall depending upon the velocity of the flow of seawater. In this way, the erratic movement of the bodies is assured to clean all the exterior surfaces of the heat exchange tubes.

Screens are provided above and below the area of the heat exchange tubes to be cleaned to prevent the floating bodies from escaping. After a time however, the friction of the cleaning action tends to wear down the polyethylene casing. The mesh holes of the screen are large enough to permit these worn floating bodies to pass through the screen for easy removal and replacement.

The flow of seawater is arranged so that the floating bodies recirculate in the area to be cleaned. The varying seawater flow allows the floating bodies to rise and fall, simultaneously cleaning the circumferences of the tubes.

OBJECTS OF THE INVENTION

Objects of the invention are to provide a descaling system apparatus comprising heat exchange tubes, floating means for cleaning the tubes, means for communicating cleaning means with the tubes and means for preventing the escape of cleaning means.

Another object of the invention is to provide floating means for cleaning the tubes comprising plastic balls sheathed in polyethylene.

Another object of the invention is to provide floating plastic balls which are fusiform shaped.

Another object of the invention is to provide heat exchange tubes mounted transversely to flowing seawater.

Another object of the invention is to provide heat exchange tubes mounted angularly, relative to one another.

Another object of the invention is to provide means for preventing the escape of cleaning means comprising screens.

Another object of the invention is to provide floating plastic balls for cleaning heat exchange tubes whereby communicating means comprising flowing fluid contacts heat exchange tubes with the floating plastic balls.

Another object of the invention is to provide floating plastic balls comprising buoyant foam.

Another object of the invention is to provide buoyant foam encased with specially selected plastic which optimizes cleaning but minimizes wear on heat exchange tubes.

Another object of the invention is to provide floating plastic balls with trailing appendages.

Further objects of the invention are to provide a method of cleaning heat exchange tubes comprising the steps of inserting against heat exchange tubes floating balls, flowing fluid down over heat exchange tubes, carrying floating balls against the tubes, abrading surfaces of the tubes by the floating balls and carrying the floating balls away from the tubes.

A further object of the invention is to provide a method of cleaning whereby new floating balls are retained by a screen.

A further object of the invention is to provide a method of cleaning whereby worn floating balls are removed through the mesh of the screen.

A further object of the invention is to provide a method of cleaning whereby the floating balls will flow upward when the velocity of the flowing fluid is low.

A further object of the invention is to provide a method of cleaning whereby the floating balls will flow downward when the velocity of the flowing fluid is high.

A further object of the invention is to provide a method of cleaning whereby the fluid flows transversely against the heat exchange tubes.

A further object of the invention is to provide a method of cleaning whereby the floating balls abrade surfaces of heat exchange tubes mounted angularly relative to one another.

BRIEF DESCRIPTION OF THE DRAWINGS

FIG. 1 is a perspective view of the heat exchange device.

FIG. 2 is a front view of the invention.

FIG. 3 is a schematic of the action of the screens.

FIGS. 4–8 show different embodiments of the floating balls used for cleaning.

DETAILED DESCRIPTION OF THE DRAWINGS

FIG. 1 is a perspective view of an embodiment of the present invention. The heat exchange apparatus 1 comprises a variety of features. The heat exchange tubes 6 are mounted longitudinally relative to the flow of seawater. The tubes 6 are mounted angularly relative to one another. Cleaning the tubes 6 is accomplished by the floating balls 14 which abrade the external surfaces of the tubes 6. The balls 14 tend to float upwards against the flow of seawater 10. By mounting the tubes 6 at angles rather than their normal horizontal position, the flow of the seawater will vary in velocity. As a result, floating balls 14 will rise or fall dependent upon the seawater flow in various areas of the heat exchange apparatus. This feature assures that all surfaces of the tubes 6 will be cleaned unlike prior art where floating cleaning objects clean in predictable patterns. Upper screen 2 and lower screen 4 are mounted at the top and bottom of the heat exchange apparatus to prevent the floating balls from escaping the heat exchange apparatus 1, and keeping the balls in circulation. When balls become worn however, the size of the screen holes are large enough to permit worn floating balls to pass through the upper screen 2 for easy removal. Seawater flowing through the tubes 6 escapes through a funnel shaped plenum 12 mounted at an end of the heat exchanger 1. The plenum is a fairly standard feature found in heat exchange apparatus.

FIG. 2 is a front view of the heat exchange apparatus 1. The tubes 6 can be seen mounted asymmetrically thus assuring a varying seawater flow. The seawater flow 10 travels vertically downward transversely to the tubes 6. Upper and lower screens 2 and 4 respectively are mounted above and below the heat exchange apparatus 1 to prevent the floating objects from escaping. Worn floating objects 8 pass through the mesh of the upper screen 2 permitting easy removal. Water flowing through the tubes escapes the heat exchange apparatus 1 through the funnel shaped opening of the plenum 12.

FIG. 3 is a schematic view of the action of the upper and lower screens 2 and 4 respectively as they keep floating balls within the heat exchange apparatus. Floating balls 14 which are not worn bounce off the upper screen 2 to be used again to clean the tubes (not shown). As the floating balls 14 become progressively worn, they will be able to pass through the holes in upper screen 2 for removal. In this way, balls no longer useful for cleaning will be automatically eliminated and replaced by new floating balls thus maintaining the cleaning of the tubes.

FIGS. 4–8 show a variety of possible embodiments of floating balls. Regardless of the ultimate shape of the floating balls, they each have a buoyant frame case 9 of either spherically or ovally shaped. Surrounding the buoyant frame case 9 is a harder plastic casing 16 which abrades and cleans the heat exchange tubes. Appendages may be added to increase the random movement of the floating balls. In its simplest embodiment, the foam case 9 is surrounded by an oval plastic casing 16 made of any number of plastics, polyethylene, for example. A second embodiment shows a foam case 9 surrounded by an elongated oval casing 11. A third embodiment shows the foam case 9 surrounded by oval casing 18. Appendage 20 shaped like an arrow tail is mounted on the plastic casing to increase the random movement of the floating body. A fourth embodiment shows a foam case 9 with oval shaped casing similar to the third embodiment. Appendage 22 is attached to the casing similarly to the third embodiment. A fifth embodiment shows floating body 24 with foam case 26 with casing 30 and trailing appendages 28 to provide drag as needed and to assist random movement.

While the invention has been described with reference to a specific embodiment, the exact nature and scope of the invention is defined in the following claims.

What is claimed is:

1. A descaling system comprising a plurality of heat exchange tubes in a tank of downward flowing seawater, having areas of varying vertical velocity, floating cleaning means for cleaning outsides of the heat exchange tubes, seawater flow directing means for directing seawater downward over outsides of the tubes and carrying the cleaning means downward with the seawater in areas of maximum downward velocity of the seawater and permitting the floating cleaning means to move upward in areas of lesser downward velocity of the seawater, thereby contacting and communicating the floating cleaning means with the outsides of the tubes, means for preventing the escape of new cleaning means and means for effecting automatic and continuous removal of worn cleaning means.

2. The system of claim 1 wherein
the floating cleaning means for cleaning the tubes comprise plastic balls sheathed in polyethylene.

3. The system of claim 2 wherein
the floating plastic balls are fusiform shaped.

4. The system of claim 2 wherein
the floating plastic balls have trailing appendages.

5. The system of claim 1 wherein
the heat exchange tubes are mounted transversely to downward flowing seawater.

6. The system of claim 1 wherein
the heat exchange tubes are mounted angularly, relative to one another.

7. The system of claim 1 wherein
the means for preventing the escape of the floating cleaning means comprise screens.

8. The system of claim 7 wherein the size of the mesh of the screens prevents new floating cleaning means from escaping the tank in which the heat exchange tubes are positioned.

9. The system of claim 7 where the size of the mesh of the screens permits automatic and continuous escape of worn floating cleaning means.

10. A descaling system comprising means for mounting heat exchange tubes in a heat exchanger, means for flowing fluid downward across the tubes with varied velocities of the fluid in different areas of the heat exchanger, floating plastic balls in the heat exchanger for cleaning the outside of the heat exchange tubes, whereby downward flowing fluid agitates the floating plastic balls and brings the floating plastic balls into contact with all outside areas of the heat exchange tubes by carrying the balls downward in areas of greater downward velocity of the fluid and allowing the balls to float upward in areas of lesser downward velocity of the fluid.

11. The system of claim 10 wherein
the floating plastic balls comprise buoyant foam.

12. The system of claim 11 wherein
the buoyant foam is encased with specially selected plastic which optimizes cleaning but minimizes wear on heat exchange tubes.

13. The system of claim 10 wherein
the floating plastic balls are fusiform shaped.

14. The system of claim 10 wherein
the floating plastic balls have trailing appendages.

15. A method of cleaning heat exchange tubes comprising the steps of
inserting against heat exchange tubes floating balls
flowing fluid down over heat exchange tubes
carrying floating balls against outsides of the tubes
cleaning surfaces of the tubes by the floating balls
carrying the floating balls away from the tubes,
varying velocity of the downward flowing fluid
floating balls upward where the velocity of the flowing fluid is low,
carrying balls downward when the velocity of the downward flowing fluid is high.

16. A method of cleaning of claim 15 whereby new floating balls are retained by screens.

17. A method of cleaning of claim 16 whereby worn floating balls are removed through the mesh of the screens.

18. A method of cleaning of claim 15 whereby the downward flowing fluid varies in velocity in different portions due to the placement of the heat exchange tubes.

19. A method of cleaning of claim 15 whereby
the fluid flows downward transversely against the heat exchange tubes.

20. A method of cleaning of claim 15 whereby
the floating cleaning balls clean surfaces of heat exchange tubes mounted angularly relative to one another.

21. A method of cleaning of claim 15 whereby
the downward flowing fluid recirculates
the floating balls against the heat exchange tubes.

22. A method for cleaning outsides of heat exchanger tubes comprising:
flowing fluid vertically in uniform direction and diverse vertical velocities in different areas of a heat exchanger,
mounting heat exchanger tubes transversely to vertical flow of fluid,
providing cleaning devices having buoyancies which tend to permit the devices to move with the fluid in areas of greater vertical velocity of the fluid and which gravitationally move the devices counter to flow of the fluid in areas of lesser vertical velocities of the fluid, thereby moving the devices upward and downward in the heat exchanger and contacting outsides of the tubes with the fluid and devices thereby cleaning outsides of the tubes.

23. The method of claim 22 wherein the fluid is water.

24. The method of claim 23 wherein the water is seawater.

25. The method of claim 22 wherein the fluid flows downward and wherein the devices tend to float upward in areas of lesser downward velocities of the fluid.

26. The method of claim 25 further comprising preventing downward egress of the devices from the heat exchanger and permitting upward egress of worn and undersized devices from the heat exchanger.

27. Apparatus for cleaning heat exchanger tubes mounted transversely to vertical flow of fluid comprising:

a heat exchanger having upper and lower ends, means for flowing fluid in one end and out the other with varied vertical velocities in diverse areas of the heat exchanger, heat exchanger tubes mounted transverse to a vertical direction, cleaning devices having buoyancy in the fluid such that the devices move with the fluid in areas of higher vertical velocity of the fluid and move vertically oppositely to the fluid in areas of lesser vertical velocity of the fluid, and upper and lower screens connected respectively at upper and lower ends of the heat exchanger for retaining the devices within the heat exchanger.

28. The apparatus of claim 27 wherein the means for flowing fluid comprises means for flowing seawater downward through the heat exchanger, in the upper end and out the lower end, and wherein the devices have positive buoyancy and float in the seawater in a manner such that seawater flowing downward through the heat exchanger in areas of greater velocity entrains the devices and in areas of lesser velocities allows the devices to float upward.

29. The apparatus of claim 27 wherein the devices have trailing appendages.

30. The apparatus of claim 27 wherein the devices have fusiform.

* * * * *